United States Patent [19]

Tobita et al.

[11] 4,195,500

[45] Apr. 1, 1980

[54] AUTOMATIC WASHING MACHINE

[75] Inventors: Hideyuki Tobita, Hitachi; Koichi Nozaki, Kodaira, both of Japan

[73] Assignee: Hitachi, Ltd., Japan

[21] Appl. No.: 909,462

[22] Filed: May 25, 1978

[30] Foreign Application Priority Data

May 28, 1977 [JP] Japan ..... 52-61730

[51] Int. Cl.[2] ..... D06F 33/02

[52] U.S. Cl. ..... 68/12 R; 134/113; 340/517; 340/525; 340/534; 340/613; 340/618; 340/648

[58] Field of Search ..... 68/12 R; 307/141, 141.4; 134/57 D, 57 R, 113; 340/517, 525, 534, 679

[56] References Cited

U.S. PATENT DOCUMENTS

| | | | |
|---|---|---|---|
| 3,155,950 | 11/1964 | Foster | 340/525 X |
| 3,333,188 | 7/1967 | Eagle | 340/525 X |
| 3,403,538 | 10/1968 | Andrew et al. | 68/12 R |
| 3,764,984 | 10/1973 | McCartney | 340/525 |
| 3,986,372 | 10/1976 | Karklys | 68/12 R |

FOREIGN PATENT DOCUMENTS 51-82971 7/1976 Japan .

*Primary Examiner*—Philip R. Coe

*Attorney, Agent, or Firm*—Craig and Antonelli

[57] ABSTRACT

An automatic washing machine which automatically carries out the steps of washing, rinsing and dehydrating in accordance with a preselected program, comprises an indication means for indicating the occurrence of abnormal operation if it occurs in the steps of washing, rinsing and dehydrating, in such a manner that the indication mode differs from cause to cause of the occurrence of the abnormal operation.

6 Claims, 10 Drawing Figures

| INDI-CATION MODES | OPERATIONS | INDICATION LAMPS | | |
|---|---|---|---|---|
| | | D7 | D8 | D9 |
| $X_1$ | WASH | ○ | △ | △ |
| $X_2$ | RINSE | △ | ○ | △ |
| $X_3$ | DEHYDRATION | △ | △ | ○ |
| $X_4$ | FEED WATER ABNORMAL | ○ | □ | □ |
| $X_5$ | MOTOR DRIVE ABNORMAL | □ | ○ | □ |
| $X_6$ | MOTOR STOP ABNORMAL | □ | □ | ○ |
| $X_7$ | INCREASE OF WEIGHT OF OUTER BATH ABNORMAL | ○ | ○ | □ |
| $X_8$ | DECREASE OF WEIGHIT OF OUTER BATH ABNORMAL | ○ | □ | ○ |
| $X_9$ | DRAIN ABNORMAL | □ | ○ | ○ |
| $X_{10}$ | UNBALANCE ABNORMAL | ○ | ○ | ○ |

| INDI-CATION MODES | OPERATIONS | INDICATION LAMPS | | |
|---|---|---|---|---|
| | | D7 | D8 | D9 |
| $X_1$ | WASH | ○ | △ | △ |
| $X_2$ | RINSE | △ | ○ | △ |
| $X_3$ | DEHYDRATION | △ | △ | ○ |
| $X_4$ | FEED WATER ABNORMAL | ○ | □ | □ |
| $X_5$ | MOTOR DRIVE ABNORMAL | □ | ○ | □ |
| $X_6$ | MOTOR STOP ABNORMAL | □ | □ | ○ |
| $X_7$ | INCREASE OF WEIGHT OF OUTER BATH ABNORMAL | ○ | ○ | □ |
| $X_8$ | DECREASE OF WEIGHIT OF OUTER BATH ABNORMAL | ○ | □ | ○ |
| $X_9$ | DRAIN ABNORMAL | □ | ○ | ○ |
| $X_{10}$ | UNBALANCE ABNORMAL | ○ | ○ | ○ |

AUTOMATIC WASHING MACHINE

LIST OF PRIOR ART REFERENCES (37 CFR 1.56(a))

The following references are cited to show the state of the art:

(1) U.S. Pat. No. 3,403,538

(2) Japanese Pat. Appln. Kokai (Laid-Open) No. 82971/76, published on July 21, 1976.

The present invention relates to an automatic washing machine which automatically carries out the steps of washing, rinsing and dehydrating, and more particularly to an automatic washing machine which can indicate the occurrence of abnormal operation in the steps of washing, rinsing and draining.

In a prior art automatic washing machine such as that shown in the U.S. Pat. No. 3,403,538, the operation commands are issued in accordance with a program constructed by cam switches. Accordingly, the program is fixed and it is not possible to use the washing machine in a variety of applications. It has been proposed to construct the program by a computer such as a micro-computer and electronize a timer. In such a washing machine, the exchange of information to electrical components used in the washing machine is facilitated and a smooth operation can be carried out by constructing an optimum program.

However, when the timer is electronized, if the operation continues without knowing the occurrence of abnormal operation in the step of washing, rinsing or dehydrating, predetermined wash factor, rinse factor or dehydration factor is not attained. Accordingly, the cause of the abnormal operation should be identified at an early stage and corrected. For example, when a feed water valve is actuated without knowing that a feed water hose has a hole, when a drain valve is actuated without knowing that a drain hose is choked with rubbish, or when an electric motor is energized without knowing that the motor is locked, the steps of washing, rinsing and dehydrating cannot be carried out, or even if they are carried out a predetermined performance is not attained.

It is an object of the present invention to provide an automatic washing machine which can indicate a type of abnormal operation if such an abnormal operation occurs in the steps of washing, rinsing and dehydrating.

A feature of the present invention resides in that any abnormal operation occurred in the steps of washing, rinsing and dehydrating is indicated by an indication mode which changes from type to type of the abnormal operation.

The above and other objects, features and advantages of the present invention will be apparent from the following description of the invention when taken in conjunction with the accompanying drawings, in which.

Figure 1:
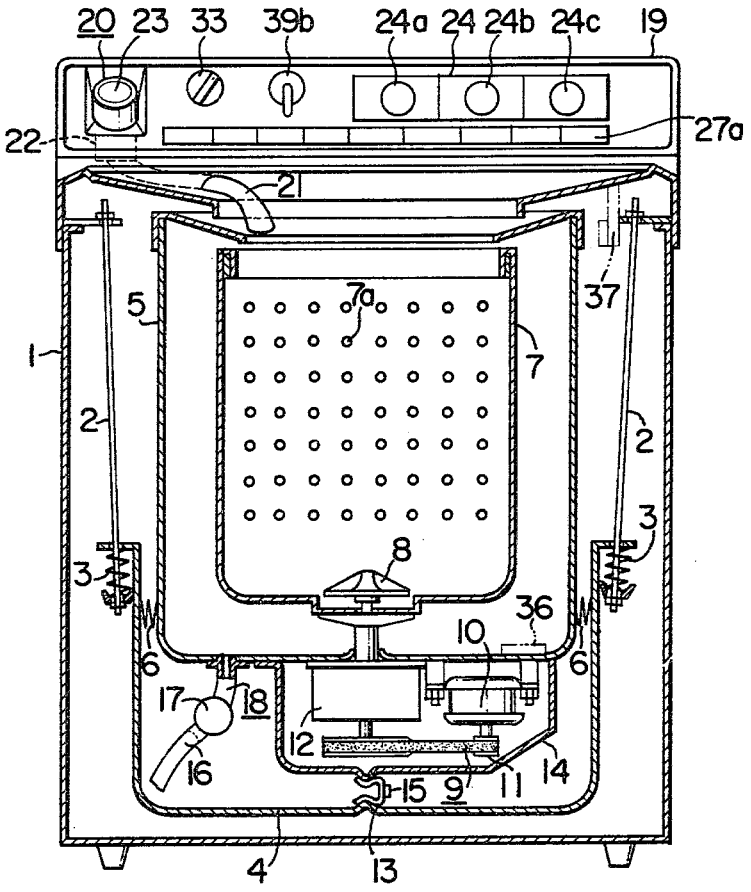
FIG. 1 shows a partial sectional view of an automatic washing machine in accordance with one embodiment of the present invention.

Referring to FIG. 1, an automatic washing machine embodying the present invention has a plurality of suspension rods 2 in an outer frame 1, and a support frame 4 is mounted on the suspension rods 2 through coil springs 3.

A tub 5 for storing water is elastically suspended to the outer frame 1 by the suspension rods 2, the support frame 4 and vibration absorbing members 6 arranged between the support frame 4 and the tub 5. A dehydration/washing basket 7 having a number of drain holes 7*a* is rotatably mounted in the tub 5. At the bottom center of the dehydration/washing basket 7, a rotary blade 8 (including agitator) is rotatably mounted. During the steps of washing and rinsing, the dehydration/washing basket 7 is stopped and the rotary blade 8 is rotated. During the dehydration step, the rotary blade 8 and the dehydration/washing basket 7 are rotated at the same speed.

The rotation of the rotary blade 8 and the dehydration/washing basket 7 is controlled by a drive unit 9 which comprises an electric motor 10, a transmission means 11 including a pulley and a belt for transmitting the rotation of the motor 10 to the rotary blade 8 or the dehydration/washing basket 7, and a clutch mechanism for selectively rotating only the rotary blade 8 or both the rotary blade 8 and the dehydration/washing basket 7.

A support member 14 made of steel to which a sensing member 13 is attached is mounted at the bottom of the tub 5. The sensing member 13 is located between the support member 14 and the support frame 4, and a weight sensor 15 is attached to the sensing member 13. The sensing member 13 is designed such that the vibration generated by the motor 10, the rotary blade 8 and the dehydration/washing basket 7 and the change of weight of the tub are exactly conveyed to the weight sensor 15. The weight sensor 15 may be a strain gauge or a pressure-sensitive semiconductor device.

A drain unit 18 including a drain hose 16 and a drain valve 17 is mounted at the bottom of the tub 5. Mounted at the rear top of the outer frame 1 is a control box 19 in which an operation means for commanding the steps of washing, rinsing and dehydrating is incorporated. Various switches for controlling the operation means are arranged on a front surface of the control box 19.

A feed water unit 20 comprises a feed water hose 21, a feed water valve 22 and a feed water port 23 which is located on the front surface of the control box 19. Water is fed from an end of the feed water hose 21 toward the rotary blade 8 in the dehydration/washing basket 7. An indication board 24 for indicating the occurrence of the abnormal operation and the progress of the program is arranged on the surface of the control box 19.

Figure 2:
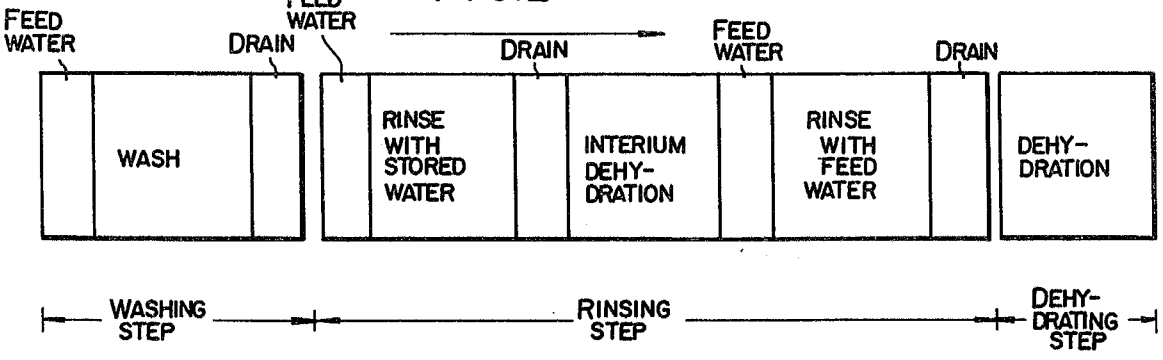
FIG. 2 illustrates a program to be carried out in the washing machine of FIG. 1.

FIG. 2 shows an example of program to be carried out by the automatic washing machine of FIG. 1. In the illustrated example, a washing step comprising feed water, wash and dehydration is followed by a rinsing step comprising feed water, rinse with stored water, drain, interium dehydration, feed water, rinse with feed water and drain, and finally a dehydration step comprising dehydration is carried out.

Figure 3:
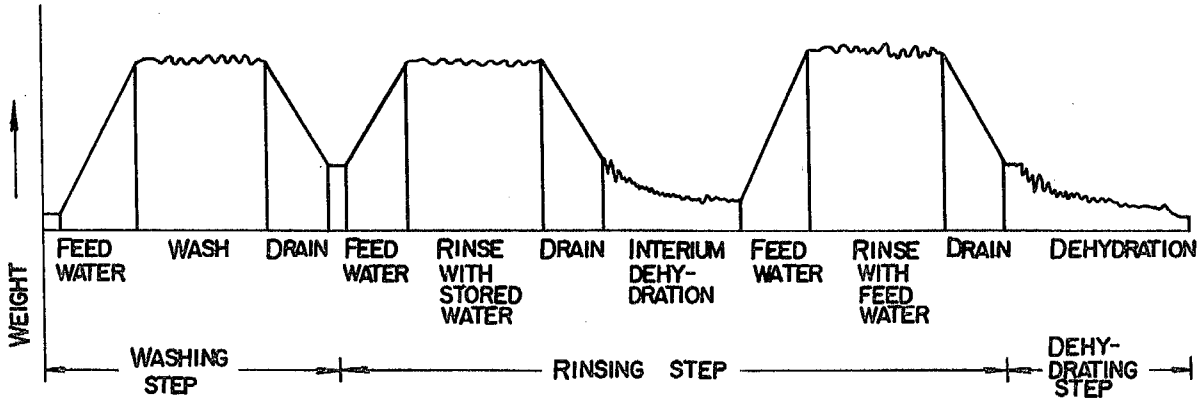
FIG. 3 shows a weight characteristic curve derived from a weight sensor used in the washing machine of FIG. 1.

FIG. 3 shows an example of a change of weight of the tub 5 sensed by the weight sensor 15 when the steps shown in FIG. 2 are normally executed. By utilizing the weight characteristic of FIG. 2, various controls can be done. Namely, by previously storing a rate of change of weight per unit time in the normal operation of the steps of FIG. 2 and comparing the stored rate of change of weight with actual rate of change of weight sensed by the weight sensor 15 in each step, the following controls can be done:

(1) During the feed water step, if a predetermined rate of change of weight is not attained after the elaspse of a predetermined time period, it is deemed that water supply is stopped or the feed water unit 20 does not work, and the occurrence of abnormal operation is indicated and the operation is stopped.

(2) During the feed water step before the washing, rinsing with stored water or rinsing with feed water, if a predetermined rate of change of weight is detected after the elapse of a predetermined time period, the rotary blade 8 is rotated and the washing and rinsing with stored water or rinsing with feed water are executed.

(3) During the drain step after washing and rinsing with stored water or rinsing with feed water have been carried out for a predetermined time period, if a predetermined rate of change of weight is not sensed after the elapse of a predetermined time period from the start of draining, it is deemed that the drain unit 18 does not work, and the occurrence of abnormal operation is indicated and the operation is stopped.

(4) During the interium dehydration step in the rinsing step, if a predetermined rate of change of weight is attained after the elapse of a predetermined time period, a feed water command is issued to start the feed water to carry out the rinsing with feed water. If the predetermined rate of change of weight is not attained after the elapse of the predetermined time period, it is deemed that the drain unit 18 does not work like in the case of (3), and the occurrence of abnormal operation is indicated and the operation is stopped.

(5) During the dehydration step, if a predetermined rate rate of change of weight is attained after the elapse of a predetermined time period, a stop operation command is issued to terminate the program. If the predetermined rate of change of weight is not attained after the elapse of the predetermined time period, it is deemed that the drain unit 18 does not work like in the cases of (3) and (4), and the occurrence of abnormal operation is indicated and the operation is stopped.

The vibrations of the motor 10 and the dehydration/washing basket 7 are conveyed to the weight sensor 15. Accordingly, by sensing those vibrations by the weight sensor 15, the following controls can be done:

(6) If the vibration of the motor 10 to be generated when the motor 10 is operating normally is not sensed by the weight sensor, it is deemed that the motor 10 is locked, and the occurrence of abnormal operation is indicated and the operation is stopped.

(7) If the dehydration/washing basket 7 vibrates abnormally, the abnormal vibration is sensed by the weight sensor 15 and the motor 10 is deenergized to stop the rotation of the dehydration/washing basket 7, and the occurrence of abnormal operation is indicated.

Figure 4:
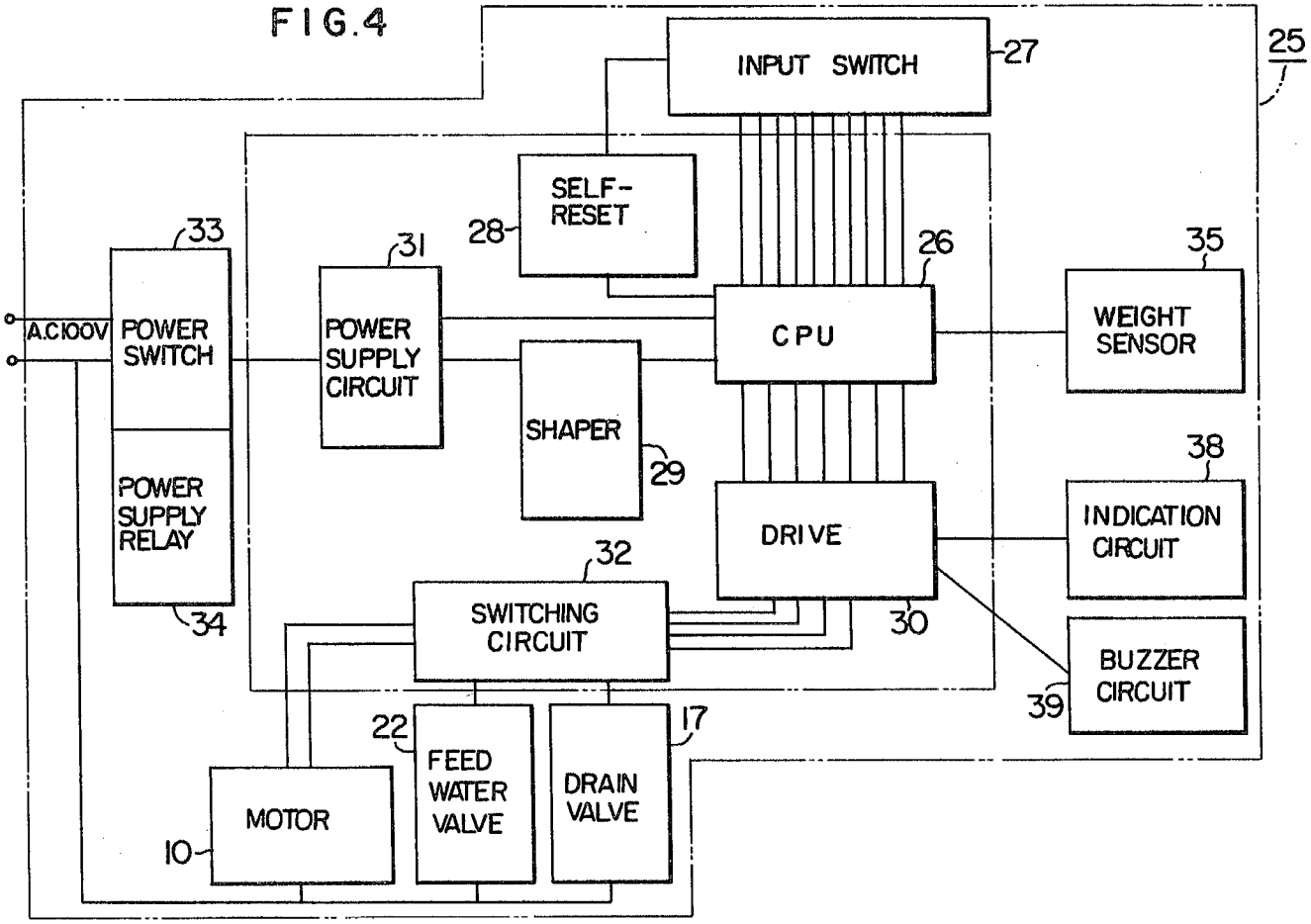
FIG. 4 shows a block diagram of an electric circuit used in the washing machine of FIG. 1.

FIG. 4 shows a block diagram of an electric circuit 25 which carries out the controls (1) to (7) described above. The electrical circuit 25 comprises an LSI central processing unit 26, an input switch 27 for selecting a program for the automatic washing machine, a self-resetting circuit 28, a shaping circuit 29, a drive circuit 30, a power supply 31, a switching circuit 32, a power switch 33, a power supply relay 34, a weight detecting circuit 35, an indication circuit 38, a buzzer circuit 39, the drain valve 17, the feed water valve 22 and the motor 10.

The weight detecting circuit receives an output signal from the weight sensor 15 and shapes it. A plurality of control buttons **27*a* of the input switch 27 are arranged on the front surface of the control box 19 shown in FIG. 1. By depressing selected one of the control buttons 27*a*, one of various program can be selected. The indication circuit 38 is operable to turn on or off or flash light emitting devices such as light emitting diodes, and the turn-on, turn-off or the flash is indicated at indication windows 24*a*, 24*b*, 24*c* on the control box 19 shown in FIG. 1. A control knob 39*b* of a switch 39*a* which is used to energize or deenergize the buzzer circuit 39 is arranged on the control box 19**.

The change of weight of the tub 5 is detected by the weight snesor 15, an analog output of which is integrated in a unit time to provide an average change, which is then differentiated so that the operation control section of the central processing unit 26 determines an increasing trend, a decreasing trend or no change. The data from the operation control section is compared with data for normal operation, which has been stored in a memory section of the central processing unit 26, by a counter control section of the central processing unit 26. If the abnormal operation is determined, an operation indication section of the central processing unit 26 supplies an abnormal indication signal to the indication circuit 38 which indicates the abnormal state on the indication board 24. The operation control section of the central processing unit 26 supplies a stop operation signal to the drive circuit 30, which in turn deenergize the circuits other than the indication circuit 38 to stop the operation.

Figure 5:
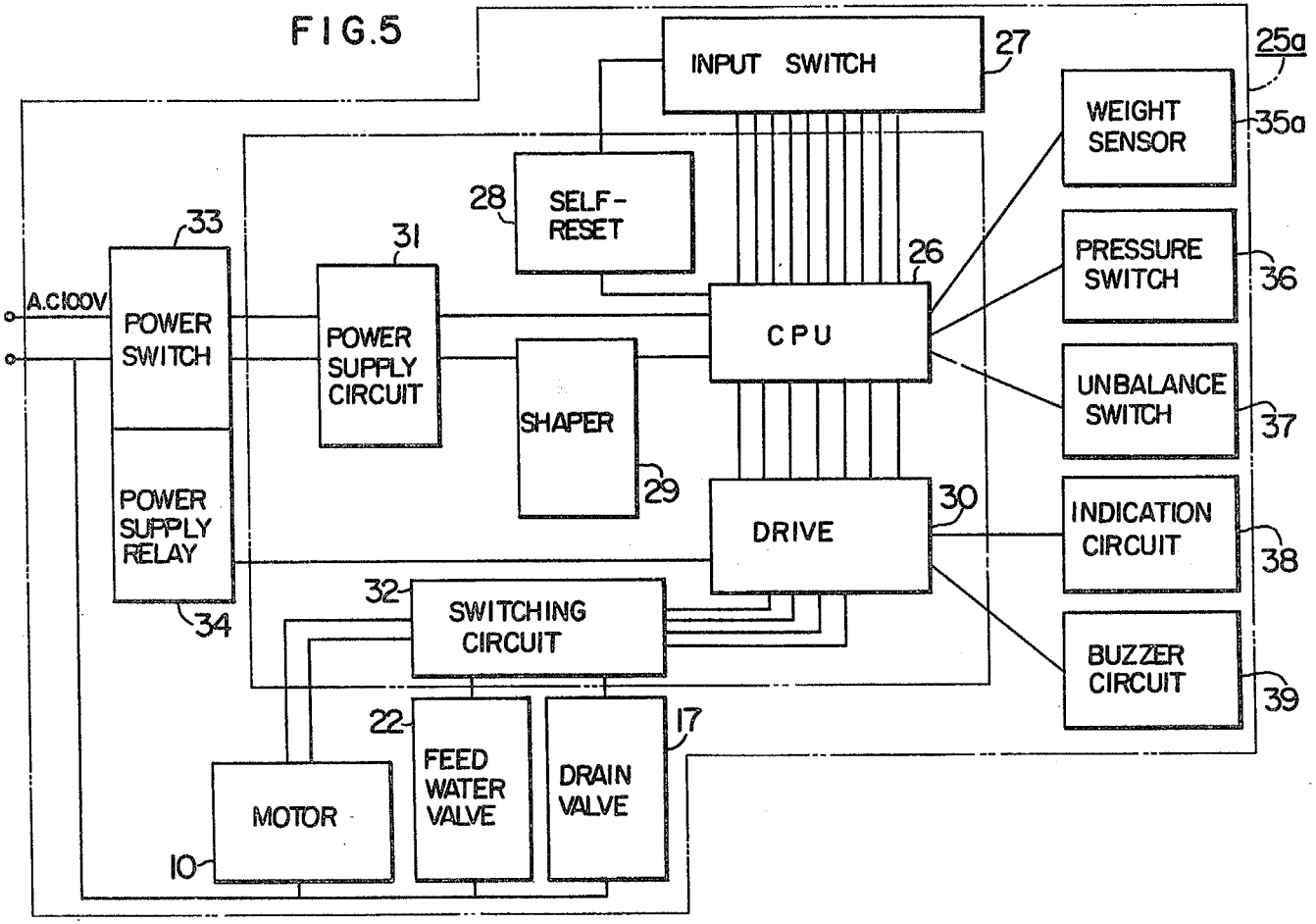
FIG. 5 shows a block diagram of another embodiment of the electric circuit used in the washing machine of FIG. 1.

FIG. 5 shows another embodiment of the electric circuit for carrying out the steps of FIG. 2. In the block diagram of the electric circuit **25*a* of FIG. 5, the like numeral to those in FIG. 4 designate like components. The electric circuit 25*a* of FIG. 5 is provided with an unbalance switch 37 for detecting overswing of the tub 5, a pressure switch 36 for detecting a pressure of water stored in the tub 5 and a weight sensor 35*a* for detecting the vibration of the motor 10 and the weight of the tub 5**.

Figure 6:
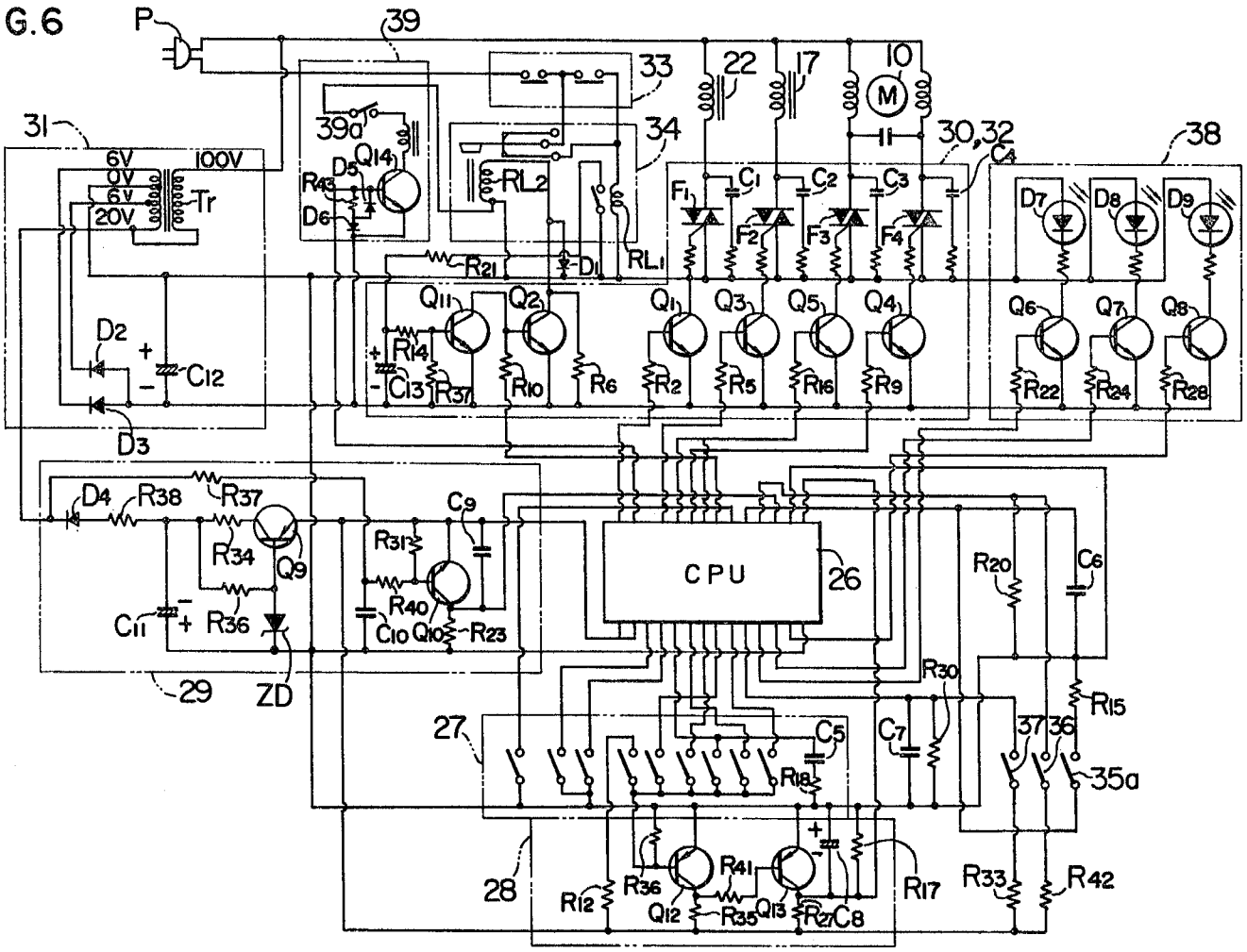
FIG. 6 shows a detailed wiring diagram for the block diagram of FIG. 5.

FIG. 6 shows a detailed wiring diagram of the electric circuit **25*a* of FIG. 5. In FIG. 6**, $R_1$ to $R_{43}$ designate signal resistors or protective resistors, $D_1$ to $D_6$ denote rectifying diodes, $C_1$ to $C_{13}$ denote filtering capacitors, signal capacitors or noise absorbing capacitors, $Q_1$ to $Q_{14}$ denote transistors, $D_7$ to $D_9$ denote light emitting diodes, $F_1$ to $F_4$ denote switching elements for switching A.C. loads, ZD denotes a zener diode, $T_r$ denotes a transformer, P denotes a plug, and $RL_1$ and $RL_2$ denote relays.

The power switch 33 is of push-off push-on type and assumes a neutral position when it is released.

The pressure switch 36 comprises a reed switch, a magnet and a reversing spring, and it is so designed that it produces a signal when water level in the tub 5 reaches a predetermined level. The pressure switch 36 is attached at the bottom of the tub 5 of FIG. 1 as shown by a signal dot chain line.

The unbalance switch 37 is so designed that it produces a signal when the tub 5 is overswung. It is attached at the outer top of the tub 5 of FIG. 1 as shown by a double dot chain line.

The central processing unit 26 responds to the signals from the pressure switch 36, the unbalance switch 37 and the weight sensor 35*a* to issue a command for turning on or off or flashing the light emitting diodes $D_7$, $D_8$, $D_9$ of the indication circuit 39, and a stop operation command.

Figures 7, 8:
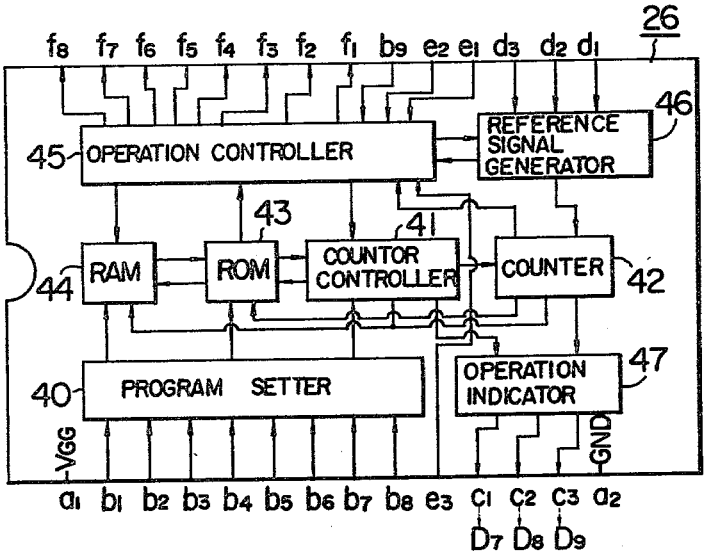
FIG. 7 shows a functional block diagram of a central processing unit shown in FIG. 5.
FIG. 8 illustrates an example of indication modes for abnormal operation used in the washing machine of FIG. 1.

Referring to FIG. 7, the central processing unit 26 is activated by input power supplied to power supply terminals $a_1$ and $a_2$. The central processing unit 26 comprises a program setter 40, a counter controller 41, a counter 42, a ROM 43, a ROM 44, an operation controller 45, a reference signal generator 46 and an operation indicator 47.

The program setter 40 is a select signal setting circuit for selecting a program for the automatic washing machine, and it comprises NAND gates and inverters. The program setter 40 receives signals from the input switch 27 through terminals $b_1$ to $b_8$. The counter controller 41 wathes the signal status of each section to issue a progress program command.

The counter 42 comprises a timer circuit which synchronizes the respective sections and times the progress of the predetermined program. The ROM 43 stores the predetermined program and the settings and it responds to the signal from the counter 42 to supply signals to the counter controller 41 and the operation controller 45.

The RAM 44 receives data in the course of the progress of the program and stores the data. The data stored in the RAM 44 are read out when a program is set. The operation controller 45 receives a signal from the pressure switch 36 via a terminal $e_1$, a signal from the unbalance switch 37 via a terminal $e_2$, a signal from the weight sensor 35*a* via a terminal $e_3$ and a signal from the input switch 27 from a terminal $b_9$. The operation controller 45 processes the signals from the pressure switch 36, the unbalance switch 37 or the weight sensor 35*a*, and the signals from the ROM 43 and the counter 42 to produce signals for controlling the motor 10, the drain valve 17, the feed water valve 22 and the buzzer circuit 39, at terminals $f_1$ to $f_8$.

The reference signal generator 46 is a timing pulse generator which receives signals at a reset terminal $d_1$, frequency selection terminal $d_2$ and a clock signal terminal $d_3$.

The operation indicator 47 responds to the command from the counter controller 41 to supply signals to output terminals $c_1$ to $c_3$ to the indication circuit 38. In response to the signals at the output terminals $c_1$ to $c_3$, the light emitting diodes $D_7$, $D_8$ and $D_9$ are turned on or off or flashed. Namely, when the output level at the output terminal $C_1$, $C_2$ or $C_3$ is continuously high, the corresponding light emitting diode is turned on, when the output level is continuously low, the corresponding light emitting diode is turned off, and when the output level repetitively assumes high level and low level within a short time period, the corresponding light emitting diode is flashed.

The combinations (hereinafter referred to indication modes) of turn-on, turn-off and flash of the three light emitting diodes $D_7$, $D_8$ and $D_9$ are shown in FIG. 8, in which symbol o represents flash, symbol Δ represents turn-off and symbol □ represents turn-on. The indication modes $X_1$, $X_2$, $X_3$ in FIG. 8 are used to indicate the progress of the washing step, rinsing step and dehydration step. Namely, when the washing step is progressing normally, the indication mode $X_1$ appears, in which the light emitting diode $D_7$ flashes and the other light emitting diodes $D_8$ and $D_9$ are turned off. When the washing step has been completed and the rinsing step is progressing normally, the indication mode $X_2$ appears in which the light emitting diode $D_8$ flashes and the other light emitting diode are turned off. When the dehydration step is progressing normally, the indication mode $X_3$ appears in which the light emitting diode $D_9$ flashes and the other light emitting diodes $D_7$ and $D_8$ are turned off. The flashing of the light emitting diodes $D_7$, $D_8$ and $D_9$ can be observed through the indication windows 24*a*, 24*b* and 24*c*, respectively so that one can determine what step is being carried out, by the position of flashing.

The indication modes $X_4$ to $X_{10}$ in FIG. 8 are used to indicate the occurrence of abnormal operation. When abnormal operation occurs in the step of washing, rinsing or dehydrating, the central processing unit 26 issues an indication command corresponding to one of the indication modes $X_4$ to $X_{10}$ shown in FIG. 8 to the indication circuit 38. As a result, the light emitting diodes $D_7$, $D_8$, $D_9$ are selectively turned on or flashed and the central processing unit 26 issues the stop operation command to deenergize all circuits other than the indication circuit 38. The occurrence of abnormal operation and the type of abnormal operation can be identified through visual observation of the indication by the light emitting diodes $D_7$, $D_8$, $D_9$ through the indication windows 24*a*, 24*b*, 24*c*. The circuit portions encircled by a single dot chain line in FIGS. 4 and 5 are mounted on a single printed circuit board which is accommodated in the control box 19 shown in FIG. 1.

Figure 9:
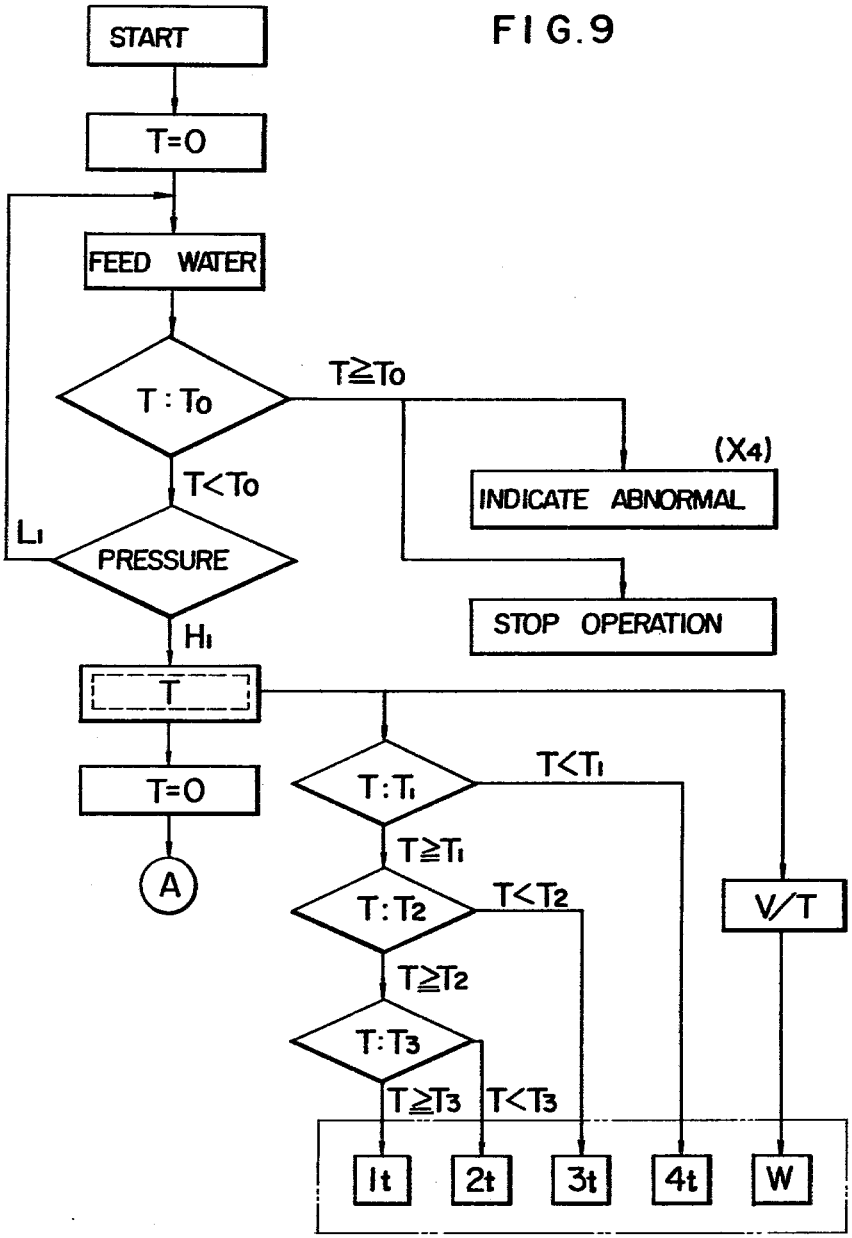
FIG. 9 shows a flow chart for detecting abnormal operation during feed water step, to be carried out in the washing machine of FIG. 1.
Figure 10:
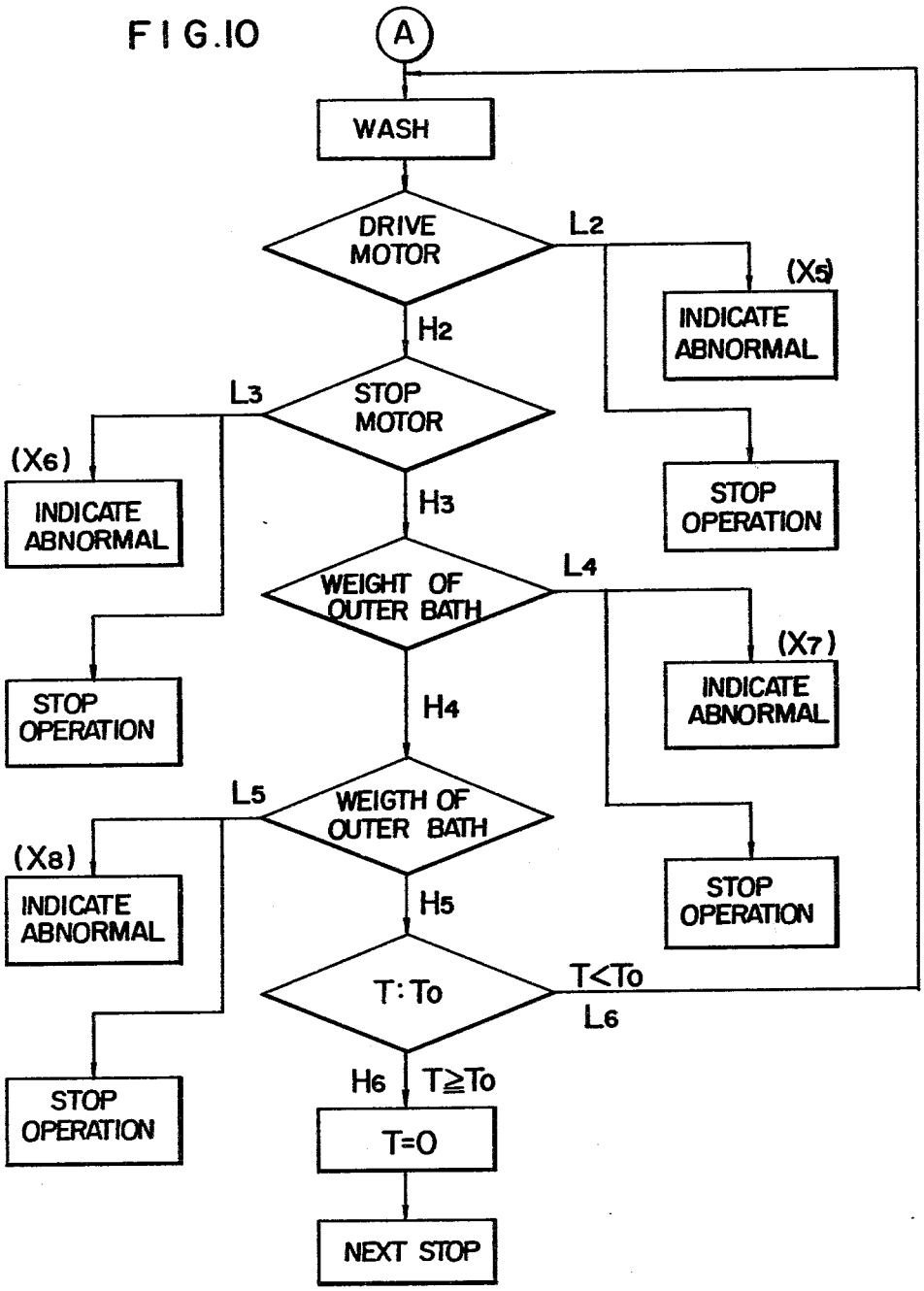
FIG. 10 shows a flow chart for detecting abnormal operation during washing step, to be carried out in the washing machine of FIG. 1.

Referring to FIGS. 9 and 10, the procedure of the washing step from the start to the end for the automatic washing machine described above is explained in detail.

In FIG. 9, after the start, the time T is set to zero and the feed water is started. During the feed water, the time T is counted up to measure the time required to fill water to a predetermined full level. If there is a trouble in feed water such as stop of water supply or freeze of water supply, a longer time is required before water is filled to the predetermined level. A time $T_o$ (e.g. five minutes) which is required to fill water to the predetermined full level when the water supply is normal is read out of the ROM 43 and it is compared with the time T. If $T \geqq T_o$ (that is, water level in the tub 5 does not reach the predetermined full level), the abnormal indication by the indication mode $X_4$ is made and the operation is stopped. More particularly, the time required before the pressure switch 36 is switched is measured by the counter 42, and the content thereof is compared with the time To which has been stored in the ROM 43. If the counter controller 41 determines the abnormal state, a command is issued to the operation indicator 47 to actuate the indication circuit 38 so that the light emitting diodes $D_7$, $D_8$, $D_9$ flash or turn on in accordance with the indication mode $X_4$.

If the water level reaches the predetermined full level within the preset time To ($T<To$), the pressure switch 36 issues a full level signal $H_1$ and the operation proceeds to the next decision step. If non-full level signal $L_1$ instead of the full level signal $H_1$ is detected, the feed water is continued as shown in FIG. 9.

The time $T_1$ required before the water level in the tub 5 reaches the predetermined full level and the pressure switch 36 produces the full level signal $H_1$, is stored in the RAM 44 for subsequent use in many ways. For example, based on the time T, a flow rate (l/min) of water fed into the tub 5 can be determined. Since the amount of water V stored in the tub 5 is predetermined, it is previously stored in the ROM 43. By dividing the amount V by the time T stored in the RAM 44, the flow rate W ($=V/T$) is obtained. The flow rate W is stored at another address of the RAM 44 so that the time required for the next feed water can be predicted and hence the total time required to complete the all steps can be determined.

Furthermore, based on the time T the capacity of the water supply can be determined. For example, $T_1$, $T_2$ and $T_3$ are set to 2.5 minutes, 3 minutes and 3.5 minutes, respectively. If $T<T$, $T<T_2$, $T<T_3$ or $T\geqq T_3$, indications 4*t*, 3*t*, 2*t* or 1*t*, respectively, are made as shown at the bottom of FIG. 9 or corresponding signals are produced. From those indications or signals, the capacity of the water supply can be determined.

In order to carry out the rinsing step in compliance with the capacity of the water supply, the feed water time is set to a maximum when the capacity of the water supply is small, such as 1*t* in FIG. 9, and the feed water time is set to a minimum when the capacity of the water supply is large, such as 4*t* in FIG. 9.

The feed water is terminated by the operation controller 45, which responses to the signal from the pressure switch 36 to block the signal to the feed water unit 20. One of the signals 1*t* to 4*t* shown in FIG. 9 is stored in the RAM 44. The program proceeds in accordance with the content of the ROM 43, and when it proceeds to the rinsing step with feed water, the time stored in the RAM 44 is read out to determine the time of rinsing step with feed water.

When the feed water is completed, the decision is mode as shown in FIG. 10 and the washing step is stored. If the weight sensor 35*a* produces a low level signal $L_2$ while the motor 10 operates, the abnormal indication shown by the indication mode $X_5$ is made and the operation is stopped. If the weight sensor 35*a* produces a high level signal $H_2$, the operation proceeds to the next step.

If the motor 10 does not stop when it is to stop, a signal $L_3$ is produced so that the abnormal indication as shown by the indication mode $X_6$ is made and the operation is stopped. If the motor 10 stops, a signal $H_3$ is produced and the operation proceeds to the next step. The stop or non-stop condition of the motor 10 may be detected by a rotation speed detecting means such as tacho-generator, instead of the weight sensor 35*a*.

After the stop condition of the motor 10 has been determined, the washing step (with the rotary blade 8 being rotated) is carried out. Since the feed water unit 20 is deactivated by the full level signal at this time, water is not to be fed to the tub 5 and hence the weight of the tub 5 is to neither increase nor decrease. However, if the feed water unit 20 is out of order, the weight of the tub 5 may increase. In such a case, a signal $L_4$ is produced to make the abnormal indication as shown by the indication mode $X_7$ and stop the operation. When the weight of the tub 5 does not change or decrease, a signal $H_4$ is produced and the operation proceeds to the next decision step.

If a signal $L_5$ indicative of the decrease of the weight of the tub 5 is produced, it is deemed that water is leaking from the drain unit 18 and the abnormal indication by the indication mode $X_8$ is made and the operation is stopped.

If there is no abnormal condition, a signal $L_6$ is produced until the preset time To has elapsed, that is, so long as $T<To$ is met so that the operation goes back to the washing step repetitively. When $T\geqq To$ is met, a signal $H_6$ is produced and the time T is set to zero, and the next step, e.g. drain step in the rinsing step starts.

The abnormal operation in the draining step is detected in a similar way to that in the feed water step. Namely, the time required before the pressure switch 36 is switched (i.e. the time required for the water level in the tub 5 to reach a predetermined low level) is measured by the counter 42, and this time is compared with the normal drain time stored in the ROM 43. If the counter controller 41 determines the abnormal operation, the operation indicator 47 produces a signal so that the abnormal indication by the indication mode $X_9$ shown in FIG. 8 is made on the indication board 24 by the indication circuit 38.

During the dehydrating step or the rinsing step, if the operation controller 45 receives a signal from the unbalance switch 37, the abnormal indication by the indication mode $X_{10}$ shown in FIG. 8 is made and the operation is stopped.

As described above, since the abnormal operation is indicated in the manner explained above, one can immediately determine in what step of the program the abnormal operation occurs. Further, by comparing the indication mode indicated on the indication board 24 with an abnormal indication manual, one can readily determine a defective portion and repair that portion quickly. Furthermore, loss and reduction of efficiency, which would be brought about if the program is proceeded without knowing the occurrence of abnormal operation, can be prevented.

Moreover, since the operation of the machine is stopped upon the occurrence of the abnormal operation, the damage of the automatic washing machine due to the overswing of the tub 5 is prevented and the reliability of the operation is emhanced.

As described hereinabove, the present invention provides the automatic washing machine which can immediately indicate the occurrence of abnormal operation.

What is claimed is:

1. An automatic washing machine comprising:

an outer frame, a tub supported in said outer frame, a dehydration/washing basket rotatably supported in said tub, a rotary blade rotatably supported in said dehydration/washing basket, a drive unit operable to rotate said rotary blade during a washing step and a rinsing step and rotate said dehydration/washing basket during a dehydrating step, a feed water unit for feeding water into said tub, a drain unit for draining water stored in said tub, an operating means for controlling said drive unit, said feed water unit and said drain unit in accordance with a predetermined program to automatically carry out the steps of washing, rinsing and dehydrating, and an indication means for indicating the occurrence of any abnormal operation if it occurs during the steps of washing, rinsing and dehydrating, by a unique indication mode which differs depending on the type of abnormal operation, wherein said indication means comprises a plurality of light emitting elements and means for controlling turn-on, turn-off, and flashing of said light emitting elements so that indication modes differ depending on the type of abnormal operation.

2. An automatic washing machine according to claim 1, further comprising a means responsive to the occurrence of abnormal operation to deactivate said drive unit, said feed water unit and said drain unit.

3. An automatic washing machine according to claim 1 further comprising a means for elastically suspending said tub, said dehydration/washing basket, said rotary blade, said drive unit and said drain unit to said outer frame, and a weight sensor means for detecting a change of weight of said tub to control said operating means.

4. An automatic washing machine according to claim 3 further comprising a means for storing a rate of change of weight of said tub per unit time during a normal operation of the steps of washing, rinsing and dehydrating, a compare means for comparing the stored rate of change of weight with an actual rate of change of weight detected by said weight sensor means, and a means responsive to the determination of non-identity of said rates of change of weight by said compare means to issue a command to indicate the occurrence of abnormal operation and a command to stop the operations of said drive unit, said feed water unit and said drain unit.

5. An automatic washing appliance of the type including a wash tub, a water feed unit, water drain unit, agitator, drive unit and control means for carrying out washing, rinsing, and dehydrating steps, comprising:

malfunction identification means for identifying the nature of any of a plurality of abnormal operations, should they occur during any of the washing, rinsing and dehydrating steps, said malfunction identification means including a number of indicator elements, said elements being fewer in number than said plurality of identifiable abnormal operations, and means for changing the manner in which said indicator elements are perceivable, wherein said indicator elements are a plurality of light emitting elements, and said means for changing includes means for turning on, turning off, and flashing said light emitting elements in different combinations depending on the type of abnormal operation that occurs.

6. An automatic washing machine according to claim 1, further comprising a means for storing a rate of change of weight of said tub per unit time during a normal operation of the steps of washing, rinsing and dehydrating, a compare means for comparing the stored rate of change of weight with an actual rate of change of weight detected by a tub weight rate of change sensor means, and a means responsive to the determination of non-identity of said rates of change of weight by said compare means to issue a command to indicate the occurrence of abnormal operation and a command to stop the operations of said drive unit, said feed water unit and said drain unit.

* * * * *